US006130390A

United States Patent [19]

Castonguay

[11] Patent Number: 6,130,390

[45] **Date of Patent: *Oct. 10, 2000**

[54] CONTACT POSITION INDICATOR FOR AN INDUSTRIAL-RATED CIRCUIT BREAKER

[75] Inventor: Roger N. Castonguay, Terryville, Conn.

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/878,598

[22] Filed: Jun. 19, 1997

[51] Int. Cl.[7] ..... H01H 9/16

[52] U.S. Cl. ..... 200/308; 200/401; 335/17

[58] Field of Search ..... 200/308, 400, 200/401; 335/17

[56] References Cited

U.S. PATENT DOCUMENTS 4,739,291 4/1988 Lee ..... 335/17

5,477,016 12/1995 Beginski et al. ..... 200/308 X

*Primary Examiner*—Renee Luebke

*Attorney, Agent, or Firm*—Carl B. Horton; Cantor Colburn, LLP

[57] ABSTRACT

A circuit breaker contact position indicator assembly includes an indicator lever that interacts with the circuit breaker contact carrier through a indicator lever bell crank and a contact arm bell crank to provide true ON and OFF indication of the circuit breaker contacts.

14 Claims, 5 Drawing Sheets

CONTACT POSITION INDICATOR FOR AN INDUSTRIAL-RATED CIRCUIT BREAKER

BACKGROUND OF THE INVENTION

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

The above-noted U.S. patents include means for opening and closing the circuit breaker contacts by direct access to the circuit breaker as well as from a remote location. To prevent closing the circuit breaker contacts when the associated electric equipment is undergoing replacement or repair, interlocks are required. U.S. Pat. No. 5,504,285 entitled "Circuit Breaker Indicating Flag Interlock Arrangement Operating Springs" and U.S. Pat. No. 5,478,979 entitled "Circuit Breaker Closing and Opening Interlock Assembly" provide interlock arrangements acting between the circuit breaker ON and OFF buttons to prevent inadvertent turn on of so-called "insulated case" circuit breakers wherein the circuit breaker operating components are completely contained within a common enclosure. U.S. patent application Ser. No. 08/878,594 entitled "Pushbutton Interlock Mechanism for an Industrial Rated Circuit Breaker" (filed concurrently herewith) describes a recent interlock approach that interacts with the circuit breaker indicating assembly to provide the interlock function.

It is known that circuit breaker contacts can become welded closed upon repeated intense overcurrent occurrence, especially when the circuit breaker is used within circuits that occasionally carry circuit current in excess of the circuit breaker ratings.

When multipole circuit breakers such as described in the aforementioned U.S. Pat. Nos. 3,084,238 and 3,905,489 incur one set of welded contacts while the remainder of the contacts within the separate poles remain operational, it is essential to provide indication that one of the contacts has become welded.

When higher ampere rated circuit breakers that employ a pair of arcing contacts along with a pair of main contacts operate off a common contact carrier, the arcing contacts close before the main contacts and open after the main contacts to protect the main contacts from arc deterioration. However, if either of the pair of arcing and main contacts become welded, the contact indicating assembly could indicate that the contacts are in the OFF condition since the other pair of the main or arcing contacts has separated.

This problem also arises when the circuit breaker includes three or more poles and main as well as arcing contacts are employed within each pole. The forces provided by the contact opening springs could overcome the holding forces exerted on the contact carrier, that is common to each pole, by the welded contacts and motivate the indicating assembly into the OFF condition are involved.

One purpose of the invention, accordingly, is to prevent the contact indicating assembly from providing indication of open contacts when at least one pair of the circuit breaker contacts are welded in the ON condition and the remaining contacts have moved to the OFF condition.

SUMMARY OF THE INVENTION

A circuit breaker contact position indicator assembly includes an indicating lever that interacts with the circuit breaker contact carrier through an indicator lever bell crank and a contact arm bell crank. The top lever that interconnects the bell cranks includes a lost motion slot that allows both the arcing contacts and the main contacts to become separated before moving the indicating lever to the OFF indicating position. The top lever also includes a lost motion slot that provides accurate positioning of the OFF position indicator.

DESCRIPTION OF THE PREFERRED EMBODIMENT

Figure 1:
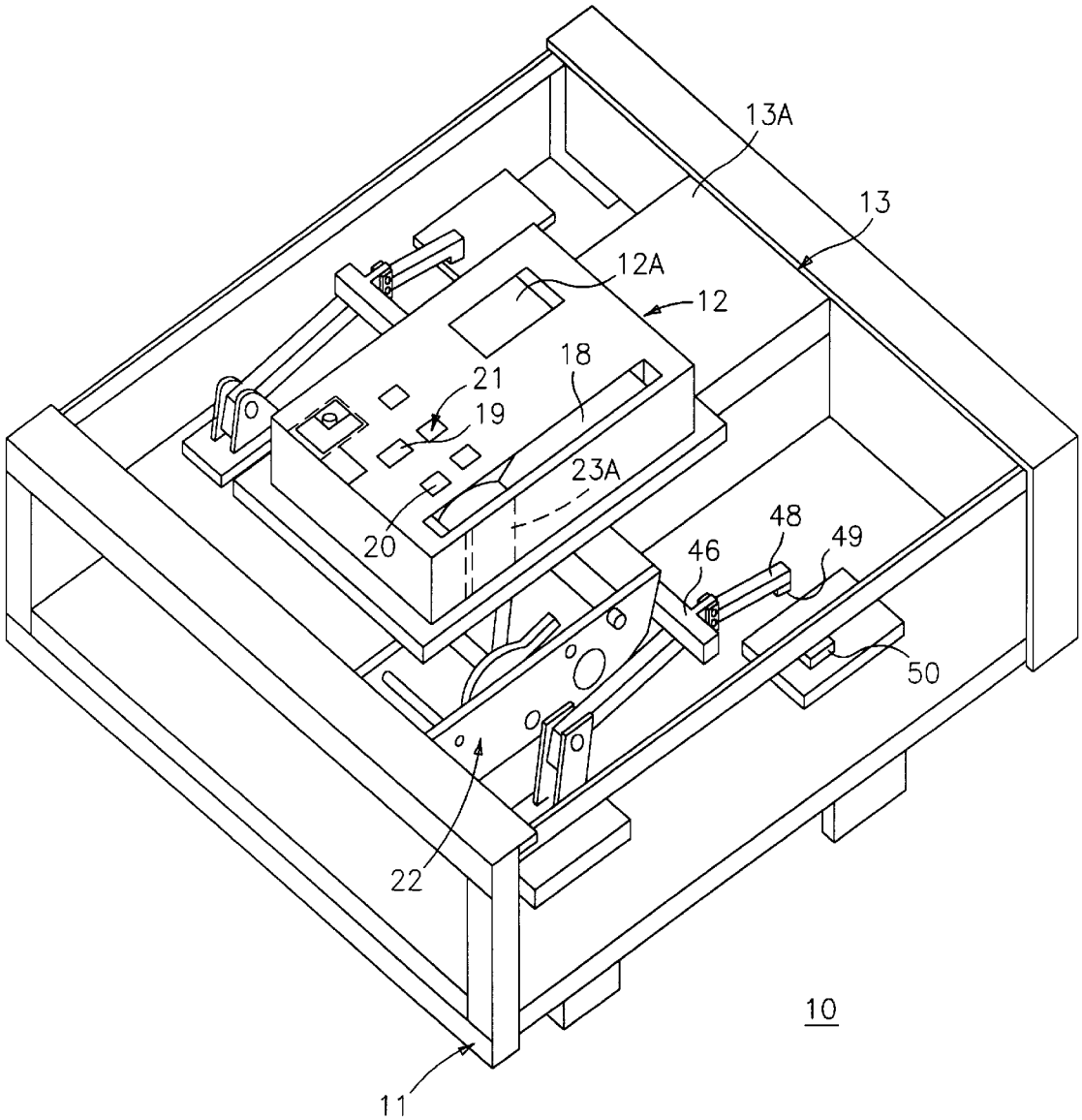
FIG. 1 is a top perspective view of an air circuit breaker containing the circuit breaker contact position indicator according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12 A and the operating mechanism enclosure 13 having an access cover 13A. The trip unit programmer is similar to that described in U.S. Pat. No. 4,672,501 entitled "Circuit Breaker and Protective Relay Unit". The circuit breaker cover further includes a trip or OFF button 19 for releasing the circuit breaker operating mechanism contained within the enclosure 13 for separating the circuit breaker arcing contacts 49, 50 to their open condition and a closing button 20 for moving the contacts to their closed position. The condition of the circuit breaker contacts is observed by means of the viewing window 21. The circuit breaker contact arms 48 within each pole of a three pole circuit arrangement, are interconnected by means of the operating mechanism crossbar 46 to insure that all contacts within the separate poles both open and close in unison. The ratchet mechanism 22 allows the operating mechanism closing springs described therein to be charged remotely by means of a motor operator. The operating handle 18 interacts with the ratchet mechanism 22 by means of a pair of plate connectors, one of which is indicated at 23A.

Figure 2:
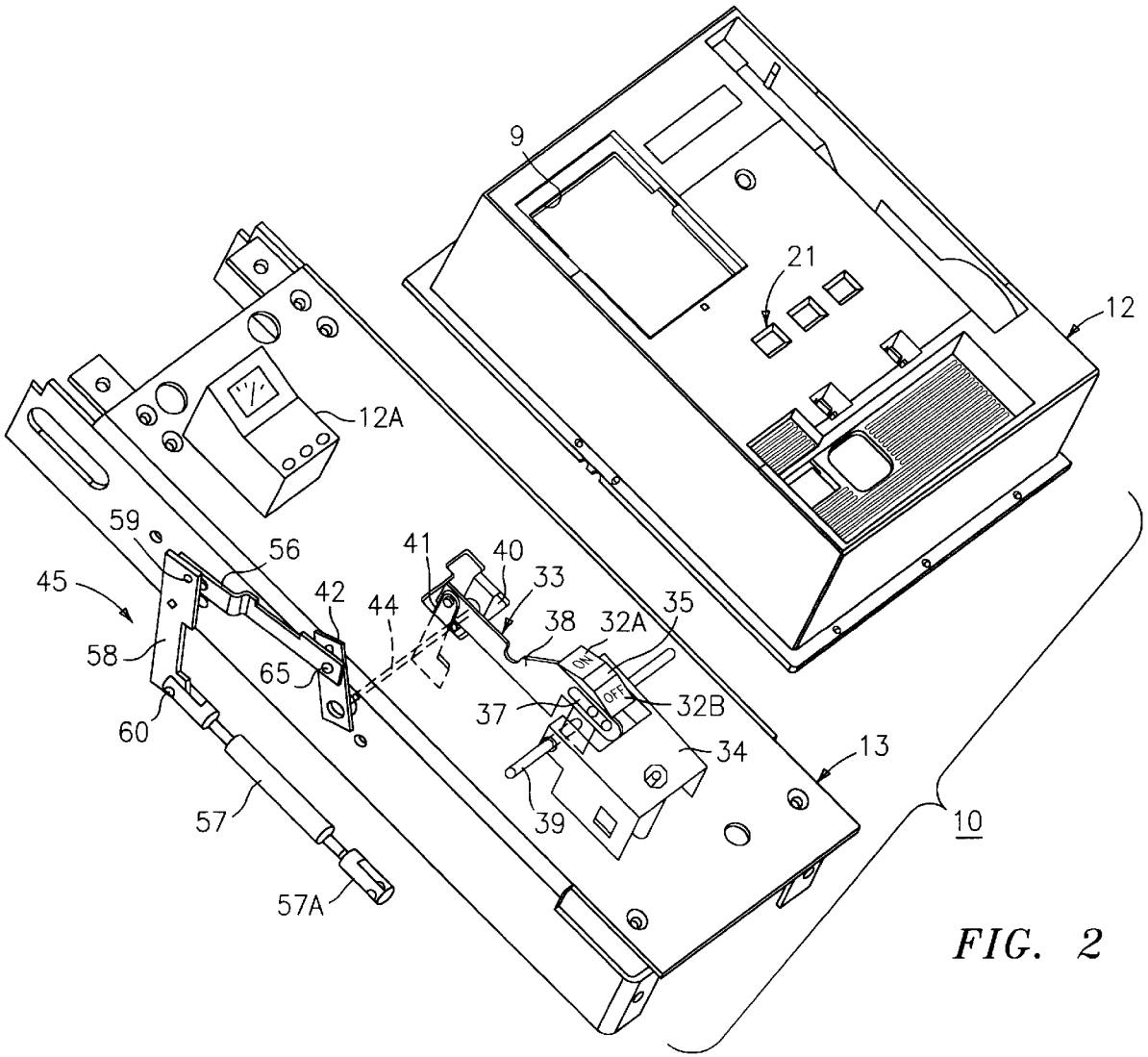
FIG. 2 is a top perspective view of the circuit breaker of FIG. 1 with the circuit breaker cover removed to depict the indicating lever assembly components.
Figure 5:
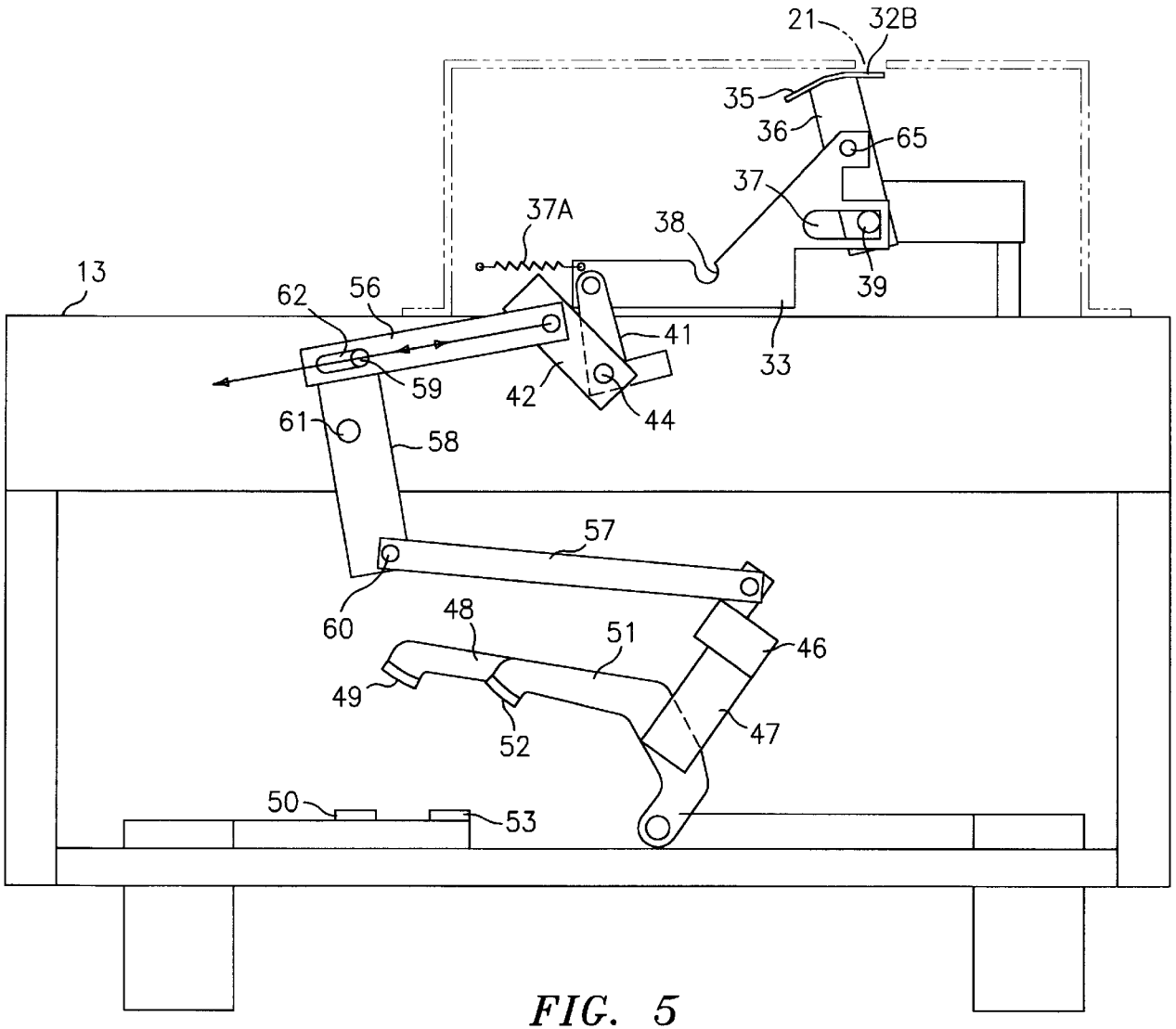
FIG. 5 is a side view of the circuit breaker of FIG. 1 depicting the circuit breaker arcing contacts and the main contacts both in the OPEN condition.

The circuit breaker 10 is depicted in FIGS. 2 and 5 with the circuit breaker cover 12 removed from the operating mechanism enclosure 13. The circuit breaker cover 12 is positioned with the trip unit access opening 9 over the trip unit programmer 12A (FIG. 1) and the viewing window 21 over the target plate 35 that carries the ON and OFF indicia, 32A, 32B respectively. The indicator lever 33 is slidably mounted on a pivot pin 39 that extends through the support platform 34 attached to the top of the operating mechanism enclosure 13. One end of the indicator lever 33 terminates in a target arm stop slot 37 that is captured about the pivot pin 39 and provides a stop when forced against the pivot pin 39 by the bias provided by the return spring 37A to accurately position the target arm 36, connected to the indicator lever 33 by pivot pin 65 (FIG. 5) and pivotally arranged on the pivot pin 39, in the OFF position as shown in FIG. 5. Slot 38, formed in the indicator lever 33 can be utilized to interact with a variety of circuit breaker accessories. The opposite end of the indicator lever 33 is attached to an L-shaped lever 41 which, in turn, connects with the indicator lever bell crank 42 by means of the common pivot pin 44. The L-shaped lever extends within the operating mechanism enclosure 13 by means of the slot 40 and interacts with the indicator lever bell crank 42 that forms part of the contact arm connector assembly generally depicted at 45. The indicator lever bell crank 42 connects with the contact arm bell crank 58 by means of the top lever 56 that is shown connecting with the top of the contact arm bell crank 58 by means of the bell crank post 59 that is captured within the lost motion slot 62 formed at the end of the top lever 56. A bottom lever 57 connects with the bottom of the contact arm bell crank 58 by means of the pin 60 at one end and connects with the circuit breaker operating mechanism cross bar 46 by means of the opposite end 57A as shown in FIG. 3.

Figure 3:
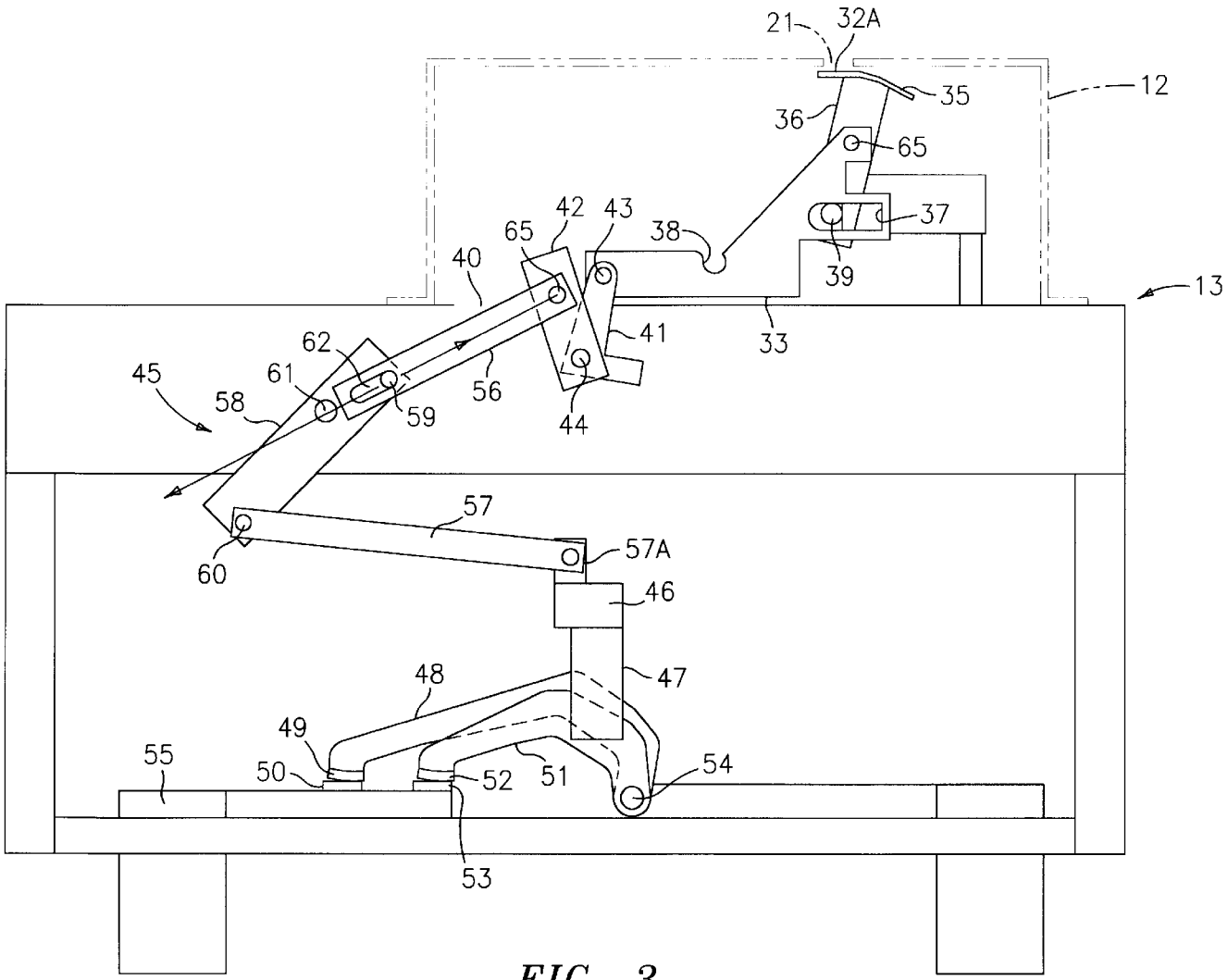
FIG. 3 is a side view of the circuit breaker of FIG. 1 depicting the circuit breaker arcing and main contacts in the CLOSED condition.
Figure 4:
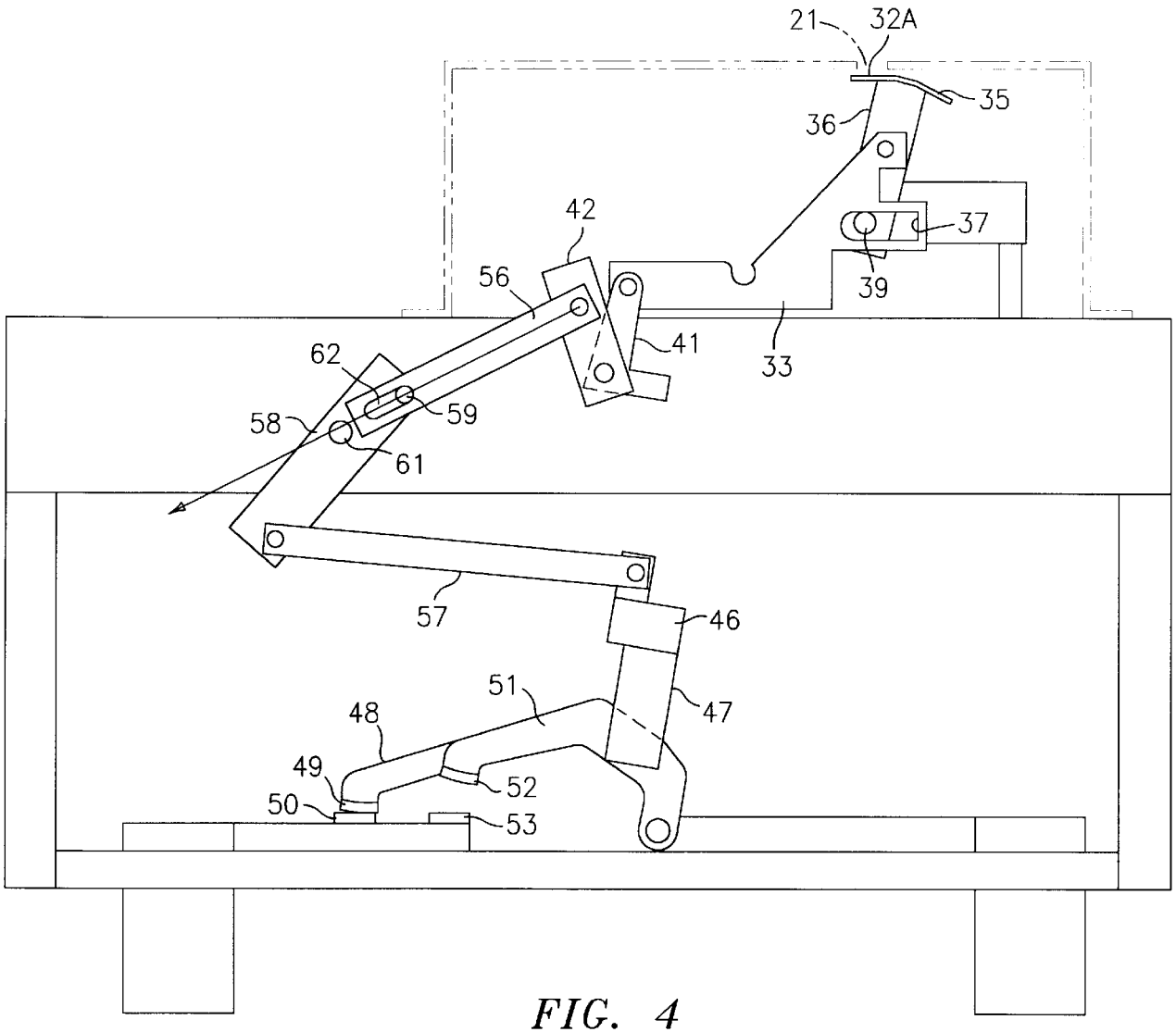
FIG. 4 is a side view of the circuit breaker of FIG. 1 depicting the circuit breaker arcing contacts in the CLOSED condition and the main contacts in the OPEN condition.

As shown in FIGS. 3, 4 and 5, the main movable contacts 52 at the end of the main contact arm 51 and the arcing movable contacts 49 at the end of the arcing contact arm 48, hereinafter "contacts", operate off a common pivot 54 and common contact carrier 47 which is attached to the circuit breaker operating mechanism crossbar 46. The main fixed contacts 53 and the arcing fixed contacts 50, hereinafter also "contacts", are attached to the contact support 55. As indicated at 57A, the bottom lever 57 within the contact arm connector assembly 45 is attached at one end to the crossbar 46. The contact arm bell crank 58 is pivotally attached to the operating mechanism enclosure 13 by means of a pivot pin 61.

FIG. 3 is illustrative of the circuit breaker contact position indicator assembly 45 with the circuit breaker contact completely closed, and where common contact carrier 47 is oriented in a first position. With the circuit breaker contacts completely closed, the bottom lever 57 drives the bell crank 58 in a clockwise direction which forces the top lever 56 to rotate the indicator lever bell crank 42 also in a clockwise direction. It is important to note that the line of action created by the two bell cranks and the top lever 56, as shown by the direction of the indicating arrows is passing through or very close to the center of the pivot of the contact arm bell crank 58 as shown at 61, thereby substantially aligning contact arm bell crank pivot 61 with contact arm bell crank post 59 and first end of top lever 56 connected to indicator lever bell crank 42. This arrangement holds the indicator lever bell crank 42 in a dwell condition resulting in only a slight movement of the indicator lever bell crank provided that the lines of action are maintained close to the bell crank pivot pin 61.

FIG. 4 is illustrative of the circuit breaker contact position indicator assembly 45 after the circuit breaker 10 has been tripped wherein the arcing contacts 49, 50 are welded closed, and where common contact carrier 47 is oriented in a second position.

When the main movable contacts 52 are open and the arcing contacts 49 are closed, as shown in FIG. 4, the line of action is very close to the bell crank pivot pin 61. As a result, there is no difference in the position of the indicator lever bell crank 42 shown in FIGS. 3 and 4. The controlled stability of the indicator bell crank 42 maintains the target plate 35 in the CLOSED position over a wide range of contact positions and is an important feature of the invention. The rotation of the indicator lever bell crank 42 in the clockwise direction by the closing of the circuit breaker contacts forces lever 41, which is positioned on a common pivot pin 44 with the indicator lever bell crank 42, to rotate clockwise such that the indicator lever 33 engages lever 41 through pin 43 and is now driven to the position indicated in FIGS. 3 and 4. The target arm 36 pivotally connects with the end of the indicator lever 33 by means of the pivot pin 65 whereby the movement of the indicator lever 33 rotates the target arm 36 in a clockwise direction to position the target plate 35 accordingly under the viewing windows 21 formed on the surface of the circuit breaker enclosure 12 such that the ON indicia 32A on the target plate 35 is visible under the viewing windows 21.

FIG. 5 is illustrative of the circuit breaker contact position indicator assembly 45 after the circuit breaker 10 has been tripped under normal operating conditions, and where common contact carrier 47 is oriented in a third position.

When the circuit breaker is tripped, the arcing and main contact arms 48, 51 open to the position indicated in FIG. 5. The interaction of the bottom lever 57 between the crossbar 46 and the contact arm bell crank 58 rotates the contact arm bell crank in the counter-clockwise direction and positions the pin 59 away from the end of the slot 62 in the top lever 56. The top lever 56 is now free to release the indicator bell crank 42 to allow rotation in the counter-clockwise direction under the bias provided by the return spring 37A. As described earlier, the return spring 37A can now return the slot 37 on lever 33 against the pivot pin 39 thereby accurately positioning the OFF indicia 32B into alignment with the viewing windows 21 to indicate that the circuit breaker contacts have completely separated. It is noted that the position of the pin 59 in the lost motion slot 62 provides sufficient lost motion to accommodate manufacturing variations so as not to move the off indicia 32B out of alignment with the viewing windows 21.

What is claimed is:

1. A circuit breaker contact position indicator for a circuit breaker having a common contact carrier attached to an operating mechanism crossbar wherein movement of said crossbar moves the common carrier from a first position through a second position to a third position; said contact position indicator comprising:

a target arm arranged for positioning a target plate under a circuit breaker case;

an indicator lever attached to said target arm at one end of said indicator lever; and a linkage assembly interconnecting said indicator lever to said operating mechanism crossbar, said linkage assembly including an indicator lever bell crank device attached to said indicator lever; a top end of a contact arm bell crank attached to said indicator lever bell crank device by a top lever, and a bottom lever connecting said crossbar to a bottom end of said contact arm bell crank, wherein said linkage assembly positions the target plate at a first target plate position when said common carrier is at said first or said second position, and at a second target plate position when said common carrier is at said third position; and wherein said top lever includes a top lever elongated slot at one end and said contact arm bell crank attaches to said top lever by capture of a contact arm bell crank post extending from one end of said contact arm bell crank within said top lever elongated slot.

2. The contact position indicator of claim 1 wherein said indicator lever bell crank device comprises:

an indicator lever bell crank having a first end connected to said top lever; and a second lever having one end connected to said indicator lever and a second end connected to a second end of said indicator lever bell crank.

3. The contact position indicator of claim 1 wherein said contact arm bell crank is attached within a circuit breaker operating mechanism enclosure by means of a contact arm bell crank pivot intermediate top and bottom ends of said contact arm bell crank.

4. The contact position indicator of claim 3 wherein the elongated slot is a predetermined length to permit said contact arm bell crank pivot to substantially align with said contact arm bell crank post and a first end of said top lever connected to said indicator lever bell crank device to releasably lock said target plate at said first position.

5. The contact position indicator of claim 4 wherein the elongated slot is a predetermined length to permit said contact arm bell crank pivot to misalign with said contact arm bell crank post and said first end of said top lever to position said target plate at said second position.

6. The contact position indicator of claim 1 wherein said target plate provides an ON indication at said first position and an OFF indication at said third position.

7. The contact position indicator of claim 1 wherein said indicator lever includes a target arm stop slot disposed at one end of said indicator lever and said target arm includes a target arm post extending from an end of said target arm, said target arm post being captured within said target arm stop slot to accurately position said target plate under a viewing window formed in the circuit breaker cover.

8. A circuit breaker having contact position indication comprising:

a common contact carrier;

an operating mechanism crossbar for moving said common contact carrier from a first position through a second position to a third position;

a circuit breaker cover arranged over an operating mechanism enclosure;

a contact position indicator arranged within said circuit breaker cover and said operating mechanism enclosure, said contact position indicator comprising;

a target arm arranged for positioning a target plate under said circuit breaker cover;

and indicator lever attached to said target arm at one end of said indicator lever; and a linkage assembly interconnecting said indicator lever to said operating mechanism crossbar, said linkage assembly including an indicator lever bell crank device attached to said indicator lever; a top end of a contact arm bell crank attached to said indicator lever bell crank device by a top lever, and a bottom lever connecting said cross bar to a bottom end of said contact arm bell crank, wherein said linkage assembly positions the target plate at a first target plate position when said common carrier is at said first or said second position, and at a second target plate position when said common carrier is at said third position; and wherein said top lever includes a top lever elongated slot at one end and said contact arm bell crank attaches to said top lever by capture of a contact arm bell crank post extending from one end of said contact arm bell crank within said top lever elongated slot.

9. The circuit breaker of claim 8 wherein said indicator lever bell crank device comprises:

an indicator lever bell crank having a first end connected to said top lever; and a second lever having one end connected to said indicator lever and a second end connected to a second end of said indicator lever bell crank.

10. The circuit breaker of claim 8 wherein said contact arm bell crank is attached within the operating mechanism enclosure by means of a contact arm bell crank pivot intermediate top and bottom ends of said contact arm bell crank.

11. The circuit breaker of claim 10 wherein the elongated slot is a predetermined length to permit said contact arm bell crank pivot to substantially align with said contact arm bell crank post and a first end of said top lever connected to said indicator lever bell crank device to releasably lock said target plate at said first position.

12. The circuit breaker of claim 11 wherein the elongated slot is a predetermined length to permit said contact arm bell crank pivot to misalign with said contact arm bell crank post and said first end of said top lever to position said target plate at said second position.

13. The circuit breaker of claim 8 wherein said target plate provides an ON indication at said first position and an OFF indication at said third position.

14. The circuit breaker of claim 8 wherein said indicator lever includes a target arm stop slot disposed at one end of said indicator lever and said target arm includes a target arm post extending from an end of said target arm, said target arm post being captured within said target arm stop slot to accurately position said target plate under a viewing window formed in the circuit breaker cover.

* * * * *